US006554720B1

(12) United States Patent
Chambers, Sr. et al.

(10) Patent No.: US 6,554,720 B1
(45) Date of Patent: Apr. 29, 2003

(54) GOLF PUTTER AND HEAD THEREFOR

(76) Inventors: Robert V. Chambers, Sr., 3179 Royal Oak Dr., Marietta, GA (US) 30068; Robert V. Chambers, Jr., 80 Paddleboat La., #731, Hilton Head, SC (US) 29928

( * ) Notice: Subject to any disclaimer, the term of this patent is extended or adjusted under 35 U.S.C. 154(b) by 0 days.

(21) Appl. No.: 09/903,231

(22) Filed: Jul. 11, 2001

(51) Int. Cl.[7] ..... A63B 53/02; A63B 53/04

(52) U.S. Cl. ..... 473/313; 473/314; 473/340; 473/341

(58) Field of Search ..... 473/340, 341, 473/305, 306, 307, 308, 309, 310, 311, 312, 313, 314, 241–255; D21/736, 742, 743, 744, 745, 746, 737, 753

(56) References Cited

U.S. PATENT DOCUMENTS

| | | | | |
|---|---|---|---|---|
| 1,678,750 | A | * | 7/1928 | Swan |
| 3,448,981 | A | * | 6/1969 | Anweiler |
| 3,880,430 | A | * | 4/1975 | McCabe |
| 4,078,806 | A | | 3/1978 | Brandell |
| 4,265,451 | A | * | 5/1981 | Bernhardt |
| 4,629,193 | A | * | 12/1986 | Pierman |
| 4,747,599 | A | * | 5/1988 | Antonious |
| 4,815,739 | A | * | 3/1989 | Donica |
| 4,834,387 | A | * | 5/1989 | Waites |
| 4,988,107 | A | * | 1/1991 | Sasse |
| 5,014,992 | A | * | 5/1991 | McCallister |
| 5,127,653 | A | | 7/1992 | Nelson |
| 5,137,275 | A | | 8/1992 | Nelson |
| 5,215,307 | A | | 6/1993 | Huffman |
| 5,344,149 | A | * | 9/1994 | Miller |
| 5,348,295 | A | | 9/1994 | Phillips |
| 5,362,048 | A | * | 11/1994 | Haste |
| 5,388,827 | A | | 2/1995 | Reynolds, Jr. |
| 5,690,556 | A | * | 11/1997 | Condon |
| 5,857,922 | A | * | 1/1999 | Delio |
| 6,039,657 | A | * | 3/2000 | Gidney |

OTHER PUBLICATIONS

The United States Golf Association (USGA); USGA 2001 Publications List; The Rules of Golf; The Rules of Golf 2000–01 Edition*; PG2000; Copyright 1999; http://www.usga.org/about/Publications_2001.html.

The United States Golf Association (USGA); Rules & Decisions; Rules of Golf & The Decision on the Rules of Golf—2000–01; Appendices II and III; Appendix II—Design of Clubs; Design of Clubs; Appendices II and III; pp. 1–4; http://www.usga.org/rules/rule_2000/appendix2.html. Design of Clubs; pp. 582–589; 1998 or before.

* cited by examiner

*Primary Examiner*—Sebastiano Passaniti
(74) *Attorney, Agent, or Firm*—Alston & Bird LLP

(57) ABSTRACT

A golf putter head with base member and wing member is disclosed. The base member has a front face for contacting a golf ball in the performance of putting a golf ball. The front face extends in a direction along the axis of elongation of the base member. The wing member is relatively wide where at its connection interface with the base member, to assure that force is applied from the wing member evenly to the base member as a golfer swings the putter. The disclosure also covers a golf putter with the disclosed putter head and shaft assembly.

32 Claims, 5 Drawing Sheets

GOLF PUTTER AND HEAD THEREFOR

BACKGROUND OF THE INVENTION

1. Field of the Invention

The claimed invention is directed to a golf putter head and shaft assembly used to putt a golf ball in the sport of golf 2. Description of the Related Art Previous golf putters commonly use a connection between shaft and base of a putter head that is relatively narrow at the point of connection to the putter head. The narrowness of this connection makes it relatively easy to inadvertently twist the putter about the shaft axis when putting a golf ball. Such putters therefore have a tendency to twist off alignment in the putting stroke, thus leading to missed putts. It would be desirable to overcome this difficulty with previous putters.

Another common problem with golf putters is their ineffective weight distribution from heel to toe. More specifically, in many putter heads, the weight is uniform from heel to toe. This can lead to twisting and misalignment of the putter head when stroking a ball with the putter. It would be desirable to overcome this disadvantage of previous putters.

Yet another common problem with putters is the face angle used in such putters. Normally, the face of such putters is at 0° with respect to vertical. However, an unexpected result of a 0° face angle is that is actually causes a ball to jump or skip upon initial contact with the putter head. Such ball behavior commonly leads to errant putts. It would be desirable to overcome this problem of previous putters.

SUMMARY OF THE INVENTION

The claimed golf putter head and putter, with its various features, overcomes the above-noted disadvantages of previous golf putters.

The invention is directed to a golf putter head for use in putting a golf ball. The golf putter head comprises a base member having a front face for contacting a golf ball, and a wing member having an end mounted to the base member. The wing member is mounted to the base member along a connection interface extending at least 2.5 centimeters in a direction along an axis of elongation of the base member. The connection interface can extend in the direction along the elongation axis at least the width of a golf ball, approximately 4.5 centimeters, to assure even application of force by the golfer to the base member in putting a golf ball. The wing member can be mounted to, the base member at a central portion thereof between its heel and toe portions. The wing member can be relatively wide where it is mounted to the base member as compared to the second end that is coupled to the connection member. The golf putter head can further comprise an extension member and a connection member. The extension member can have first and second ends, the first end coupled to a second end of the wing member opposite the end mounted to the base member. The second end of the extension member can be coupled to a relatively wide portion of a connection member. A relatively narrow portion of the connection member is coupled to the relatively wide portion thereof. The relatively narrow portion of the connection member can be coupled to a shaft assembly to form a golf putter. The base member can have a rear surface defining at least one recessed surface to distribute the weight of the base member so that the toe and heel weigh more than the central portion of the base member. The base member can be configured progressively from its sole upward to have a bottom portion defining the sole, an intermediate portion coupled to the wing member, and a top ridge portion. The golf putter head can have alignment marks on the top ridge, and toe and heel portions of the bottom portion of the base member. Distance from sole to an upper surface of a top ridge portion of the golf putter head is at least one-half of the diameter of a golf ball, or approximately 2.0 centimeters. The base member can define a front face that slopes at most −1° degrees of angle. Such front face configuration can be used to urge a: golf ball to roll rather than to jump or skip upon contact with the putter head.

A golf putter of the invention comprises the above-described golf putter head in combination,with a shaft assembly.

Further details of the construction and operation of the invention are hereinafter described and claimed. In the detailed description, reference is made to the accompanying drawings, forming a part of this disclosure, in which like numerals refer to like parts throughout the several views. The drawings are not necessarily to scale, emphasis instead being placed upon illustration of the principles of the invention.

DETAILED DESCRIPTION OF THE INVENTION

1. Definitions

As used herein, the following terms have the following definitions:

"Coupled" or "mounted" refers to joining two or more objects together by integrally casting, molding or otherwise forming such objects together, or by friction-fitting, adhesive, cement, pins, rivets, bolts, screws, nails, etc., or by welding, braising, soldering, heat fusing, or by other mechanical joining of two members together.

"Putter head" or "golf putter head" refers to the end of a putter used to make contact with a golf ball in putting the ball toward a hole on a green. The putter head is generally composed of metal such as steel, aluminum, titanium, graphite, or metal alloys, although use of other rigid materials is not precluded.

"Shaft assembly" generally refers to a shaft and hand grip that connects to the putter head to form a putter. Such shaft assemblies are widely available commercially through many sources, such as golf retailers. The shaft can be composed of steel, aluminum, titanium, graphite, or metal alloys, for example. The hand grip can be composed of plastic, leather, rubber, or other material, land provides a surface that can be readily gripped by a golfer.

2. Description of the Invention

Figure 1:
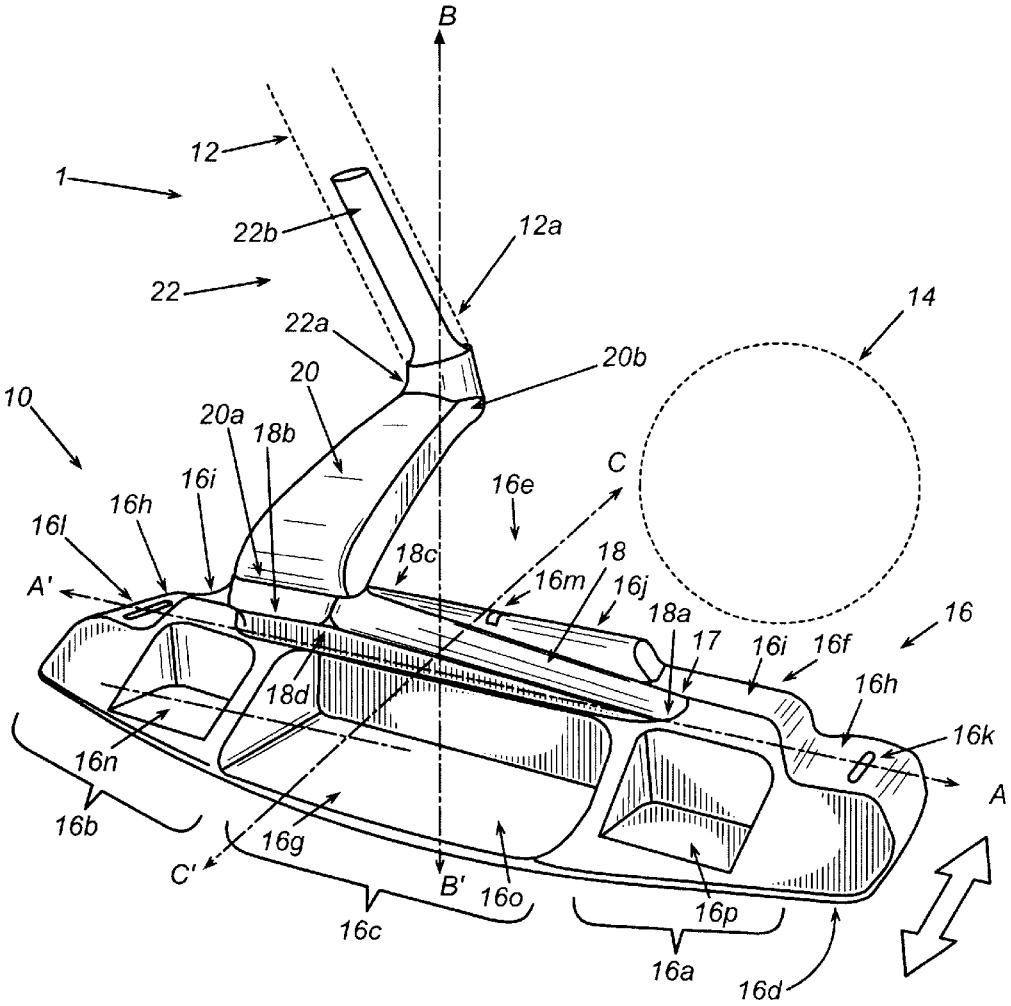
FIG. 1 is a perspective view of a golf putter with putter head and shaft assembly in accordance with the invention.

FIG. 1 is a putter 1 comprising a putter head 10 and shaft assembly 12 joined together. A golfer can grip and swing the shaft assembly 12 and attached putter head 10 that makes contact with a golf ball 14 to move same toward a hole on a golf green in a well-known manner.

The putter head 10 comprises a base member 16 and a wing, member 18. The putter head 10 can also comprise an extension member 20, and a connection member 22.

The base member 16 generally extends along its axis of elongation A–A', this forming the largest dimension of the base member as compared to its extent along the vertical axis B–B' and horizontal axis C–C'. Along the axis A–A', the base member 16 comprises a toe 16*a*, a heel 16*b*, and central portion 16*c*. The central portion 16*c* extends between the toe 16*a* and heel 16*b*. The base member 16 can comprise a sole 16*d* forming the bottom surface of the putter head, and a top surface 16*e* on the upper surface of the base member. In addition, the base member 16 can comprise a front face 16*f* for making contact with the golf ball 14, and a rear surface 16*g* on the opposite side of the front face 16*f*. The base member 16 can comprise a bottom portion 16*h*, an intermediate portion 16*i*, and a top ridge portion 16*j*. The bottom portion 16*h*, intermediate , portion 16*i*, and top ridge portion 16*j* have a tiered configuration from the toe 16*a* or heel 16*b* toward the central portion 16*c* at which the top ridge portion 16*j* is located. The distance from the top surface of the top ridge portion 16*j* to the sole 16*d* is at least one-half the width of a golf ball, approximately 2.0 centimeters. The base member 16 can define alignment marks 16*k*, 16*l*, and 16*m* on the top surface 16*e* at the toe 16*a*, heel 16*b*, and central portion 16*c* thereof. These marks can be ridges, groves, or marking defined in the base member 16 and extend parallel to the axis C–C' to facilitate proper alignment of the putter head 10 relative to the golf ball 14 in preparation for putting the ball.

The rear surface 16*g* of the base member 16 can define recessed surfaces 16*n*, 16*o*, and 16*p*. The recessed surface 16*o* renders the base member 16 relatively light at its central portion, of intermediate weight at the position of the recessed surfaces 16*n*, 16*p*, and of greatest weight at the outermost portions of the toe 16*a* and heel 16*c* along the axis A–A' relative with respect to the central portion 16*c*. This arrangement of the recessed surfaces 16*n*, 16*o*, 16*p* balances the weight of the putter head 10 to permit even swinging of the putter head on shaft assembly 12. By weighting the base member 16 in this manner, a golfer can attain relative evenness in stroke in swinging the putter 1 of the invention.

The wing member 18 can have a wedge-shaped configuration. The wing member 18 can be formed with first and second ends 18*a*, 18*b*. The first end 18*a* is mounted to the base member 16, or more specifically, to the intermediate portion 16*i* at the central portion 16*c* of the base member 16 at a connection interface 17. The connection interface 17 extends along the connected portion of the base member 16 and the wing member 18. The connection interface 17 can be a region of joinder between the base and wing members if these members are integrally formed together. Alternatively, the connection interface 17 can be a welded seam or otherwise coupled area of joinder between the base member 16 and the wing member 18. The wing member 18 extends at an angle from the base member 16 generally in a plane from 30° to 60° of rotation about axis A–A' relative to vertical axis B–B'. Such angled configuration of the wing member 18 relative to the base member 16 assures that the application of force is in significant amount from end 18*a* to end 18*b* in the direction of greatest material thickness of the wing member. This assures rigidity of the putter head 10 under application of force by the golfer in swinging the putter 1. The wing member 18 has upper and lower major surfaces 18*c*, 18*d* that are generally trapezoidal in appearance if viewed perpendicularly to such surfaces. The first end 18*a* of the wing member 18 is relatively wide along the direction of axis A–A' where it couples to the base member 16. More specifically, the first end 18*a* is at least 2.5 centimeters at portions thereof contacting the base member 16. More preferably, the first end 18*a* can be at least the entire width of a golf ball, approximately 4.5 centimeters, to assure that the force of the golfer in swinging the putter 1 is applied evenly across the front face 16*f* against the golf ball. This is a novel configuration as compared to previous putter heads. Such configuration assures that the force applied by the golfer in putting is transmitted from the shaft assembly 12 to the base member 16 with even application across the central portion 16*c* of the front face 16*f* making contact with the golf ball 14. Hence, due to the wing member 18, the golfer is relatively assured of a smooth stroke with the shaft assembly 12 and putter head 10. Thus, putting can be performed with relative accuracy using the putter head 10 of the invention.

The extension member 20 can be an elongated, arched or curved, arm. The extension member 20 couples the wing member 18 to the connection member 22. More specifically, the extension member 20 has a first end 20*a* that couples to the second end 18*b* of the wing member 18. The second end 20*b* of the extension member 20 mounts to a first portion 22*a* of the connection member 22. The first portion 22*a* of the connection member 22 is broader than the cylindrical end of the shaft assembly 12 to act as a collar or stop to secure such end. The connection member 22 also comprises a second portion 22*b* mounted at one end to the first portion 22*a*, that can be cylindrical in configuration and that has a smaller diameter than that of the first portion 22*a*. The second portion 22*b* is inserted into tube end 12*a* of the shaft assembly 12. The second portion 22*b* can extend 5.0 centimeters or more into the tube end 12*a* of the shaft assembly 12. The second portion 22*b* can be, and generally is, configured to fit in tight contact with inner surfaces of the tube end 12*a*. Adhesive can be used to further affix the second portion 22*b* to the inner surfaces of the tube end 12*a*.

Figure 2:
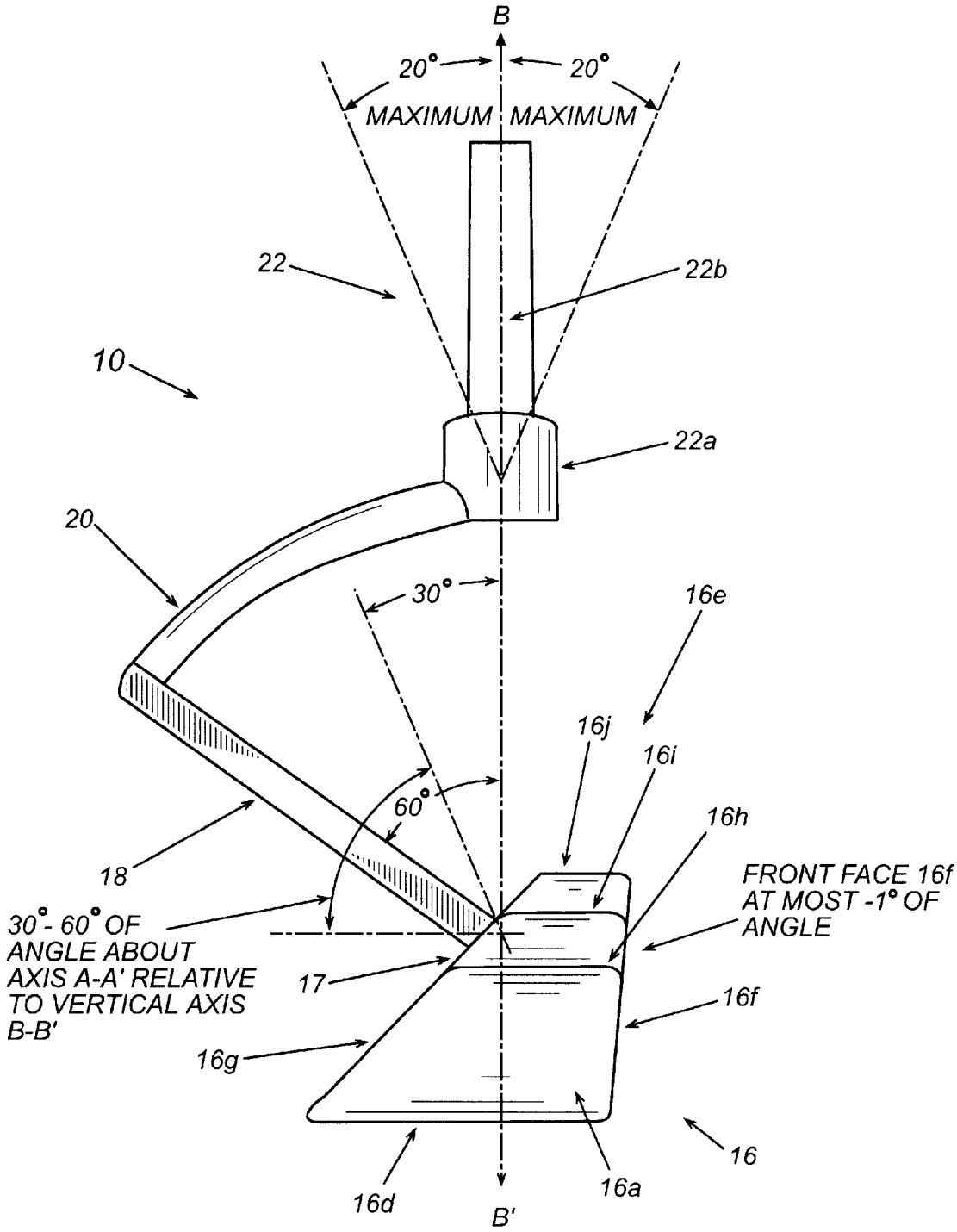
FIG. 2 is a side elevational view showing the toe of the golf putter head.

In FIG. 2 the putter head 10 is shown oriented to view the end of the toe 16*a*. As can be seen in FIG. 2, the front face 16*f* of the base member 16 has a −1° tilt or less so that the top ridge portion 16*j* is positioned forwardly of the sole 16*d*. This negative tilt of the front face 16*f* causes the base member 16 to impart force to roll the golf ball 14 as well as to move it toward a green hole. Such feature reduces the tendency of the golf ball 14 to skip or jump upon contact with the base member 16 as a golfer strokes the putter 1 in putting the ball. Also shown in FIG. 2, the wing member 18 can be tilted from 30°–60° about axis A–A' relative to axis B–B' by no more than 20° off-axis. This requirement is pursuant to the rules of the United States Golf Association ("USGA") and the Royal and Ancient Golf Club of St. Andrews ("RAGCSA").

Figure 3:
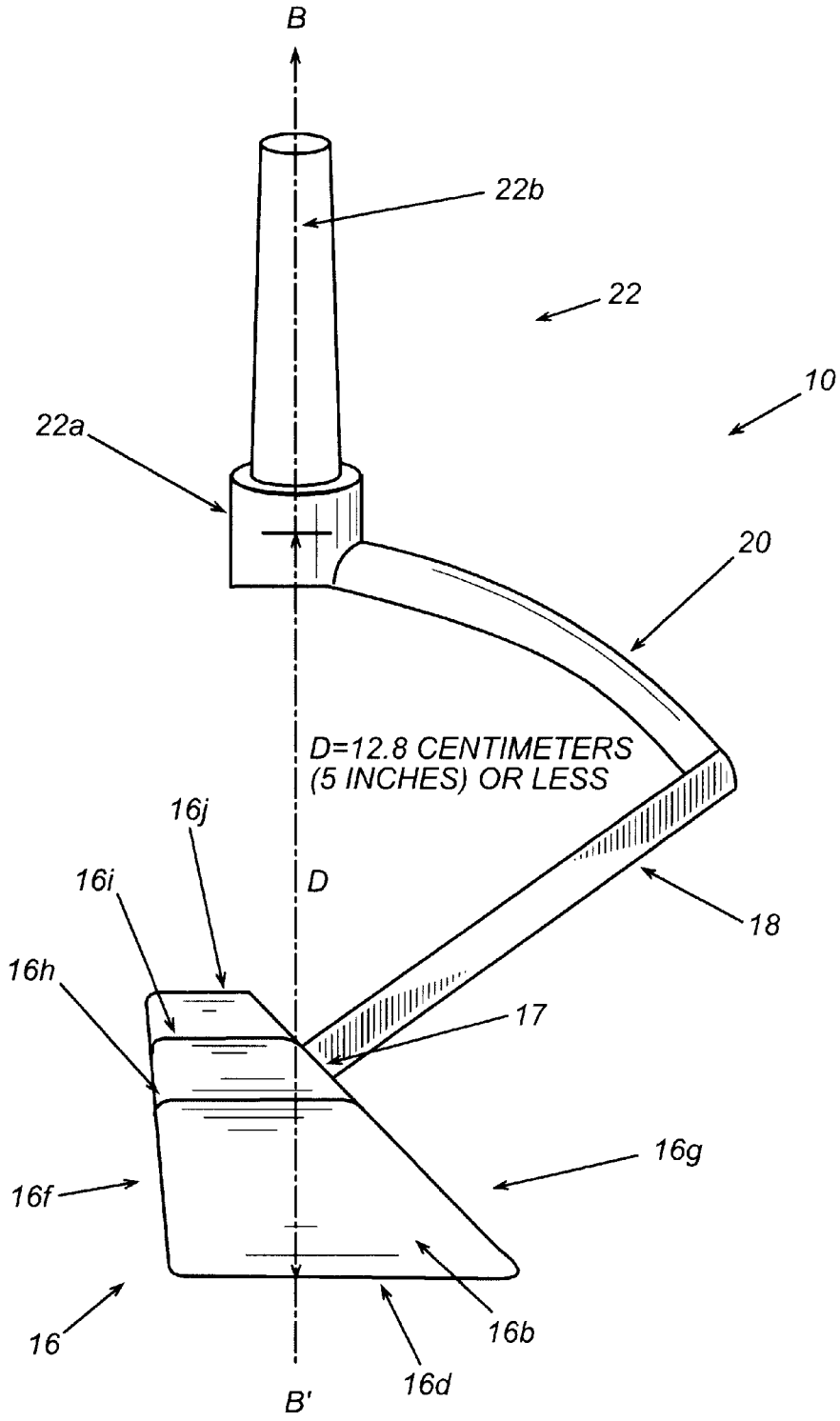
FIG. 3 is a side elevational view showing the heel of the golf putter head.

In FIG. 3 the putter head 10 is shown oriented to view the end of the heel 16*b*. As shown in FIG. 3, the distance D from the position son the portion 22*a* of connection member 22 at which extension member 20 bends off the vertical B–B' axis to the sole 16*d* of the base member 16, is 12.8 centimeters (5 inches) or less. This distance limitation achieves compliance of the putter 1 with the rules of the USGA and RAGSCSA.

Figure 4:
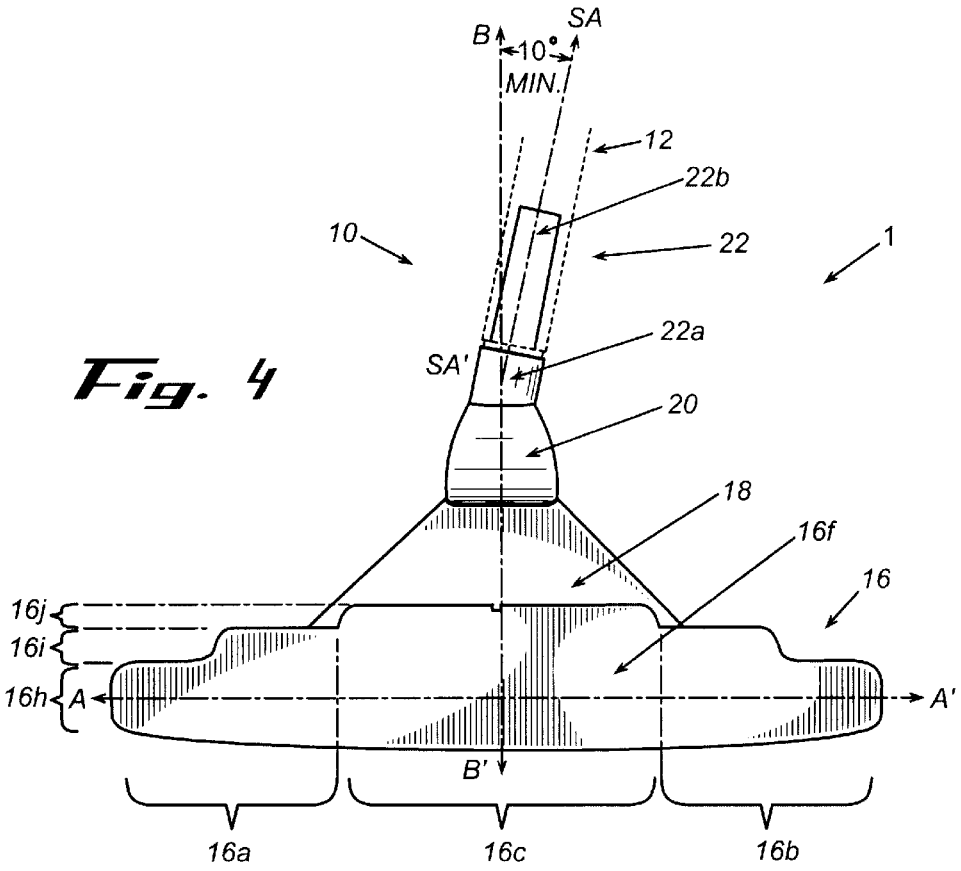
FIG. 4 is a front elevational view of the golf putter head and shaft assembly; showing the front face of the putter head used to make contact with a golf ball in the performance of putting.

FIG. 4 shows the putter head 10 oriented to view the front face 16*f* of the base member 16. FIG. 4 shows the base member's toe 16*a*, heel 16*b*, and central portion 16*c*, as well as bottom portion 16*h*, intermediate portion 16*i*, and top ridge portion 16*j*. In addition, the minimum angle between the vertical axis B–B' and the axis SA–SA' of the shaft assembly 12 is at least 10° for compliance with the rules of the USGA and RAGSCSA.

Figure 5:
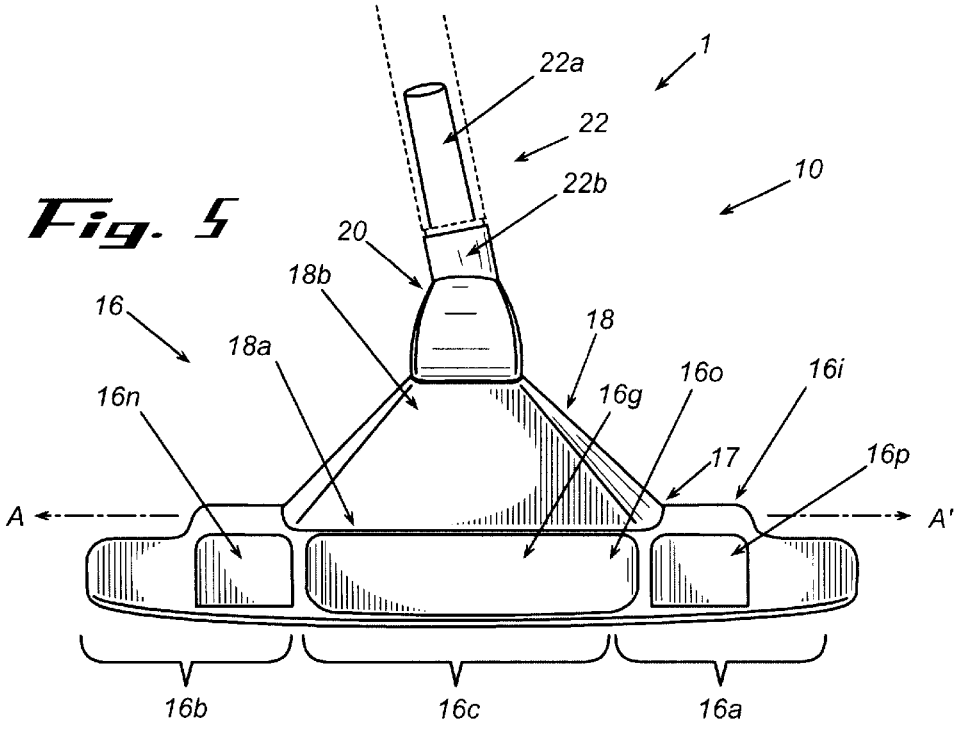
FIG. 5 is a rear elevational view of the golf putter head and shaft assembly.

FIG. 5 is a view of the putter head 10 from a vantage point opposing the rear surface 16*g* of the base member 16. In FIG. 5 the recessed surfaces 16*n*, 16*o*, 16*p* defined in the rear surface 16*g* are visible. As previously described such recessed surfaces 16*n*, 16*o*, 16*p* distribute the weight of the base member 16 away from central portion 16*c* and toward the toe 16*a* and heel 16*b* to achieve balance of the putter 1 for assurance of a smooth stroke in putting the golf ball 14.

Figure 6:
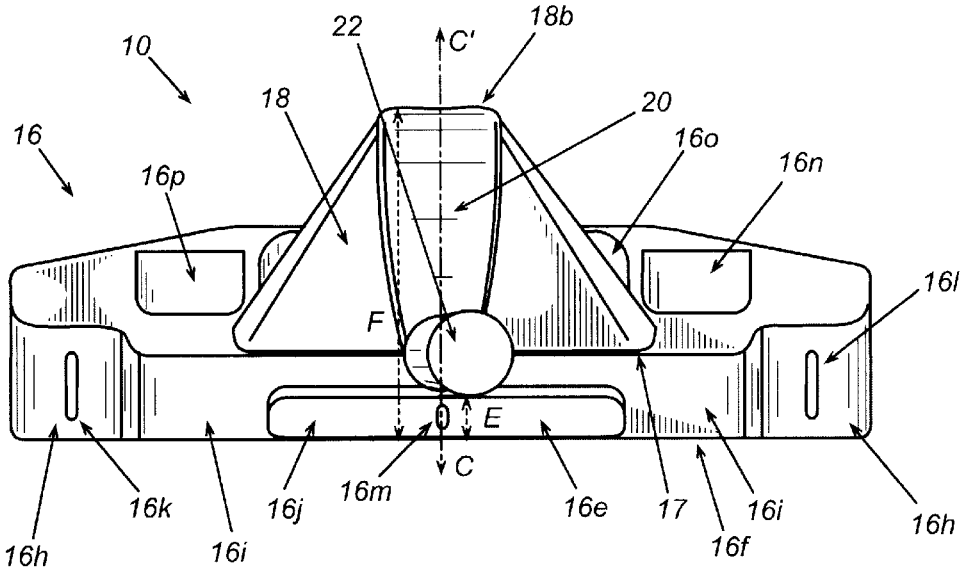
FIG. 6 is a top plan view of the golf putter head of the invention.

FIG. 6 shows the connection interface 17 that extends in a direction along the axis of elongation A–A' over the region at which the base member 16 couples to the wing member 18. More specifically, FIG. 6 indicates the connection interface 17 between the first end 18*a* of the wing member 18 that is coupled to the intermediate portion 16*i* of the base member 16. Such connection interface 17 can extend across the central portion 16*c* of the base member 16. For example, the connection interface 17 can extend in a direction along the axis A–A' of the base member 16 for at least 2.5 centimeters. However, it is more preferable that this connection inteface 17 be at least 5.0 centimeters or more. This connection interface extent assures that the force applied from wing member 18 to base member 16 by the golfer in swinging the putter 1 is applied with relative uniformity across the central portion 16*c* to evenly make contact with the golf ball 14 in the performance of putting. FIG. 6 is a view of the putter head 10 from a vantage point opposing the top surface 16*e*. This view is approximately that of a golfer in using the putter 1. Alignment marks 16*k*, 16*l*, and 16*m* are shown to assist the golfer in aligning the putter head 10 relative to the golf ball 14. It is generally advantageous in preparation to stroking the golf ball 14 to center the alignment mark 16*m* to oppose the center of the golf ball 14. Distance E along the axis C–C' from the front face 16*f* to the connection member 22 can be from 0–2.5 centimeters, for example. Distance F from the front face 16*f* to the end 18*b* of the wing member 18 can be from 2.5 centimeters to 5.0 centimeters, for example. The end 18*b* of the wing member 18 and the end 20*a* of the connection member 20 are thus coupled together at a position behind the front face 16*f* in a direction along the C–C' axis.

Figure 7:
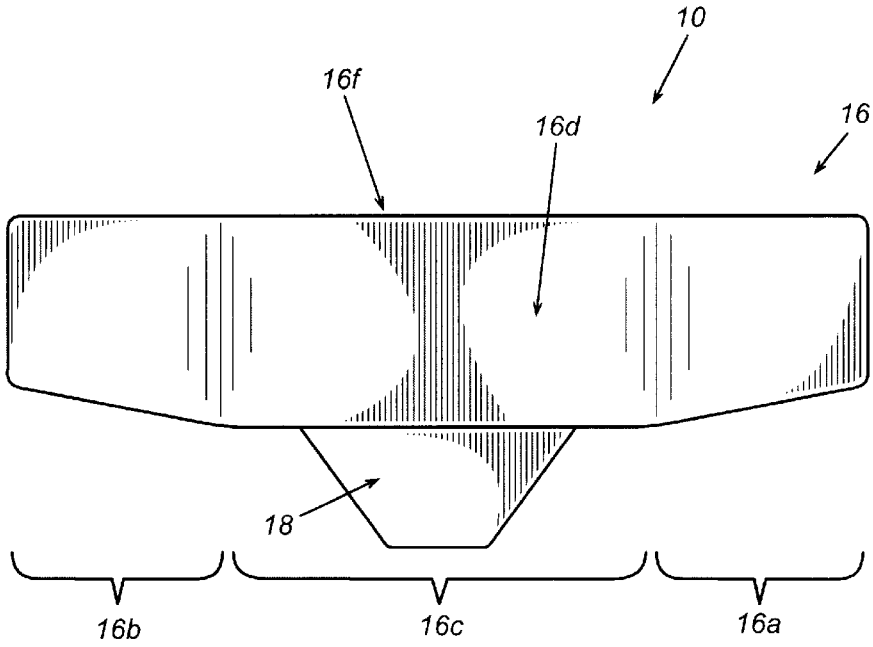
FIG. 7 is a bottom plan view of the golf putter head of the invention.

FIG. 7 is a view of the putter head 10 from a vantage point opposing the sole 16*d*. As shown in FIG. 6 the toe 16*a* and heel 16*b* can be tapered to be relatively narrow at respective extreme ends to relatively wide where such toe and heel contact the central region 16*c*.

Although the golf putter head 10 and shaft assembly 12 shown in FIGS. 1–7 is configured for right-handed golfers, the putter head 10 and shaft assembly 12 can be readily configured for left-handed golfers by tilting the connection member 22 to the opposite side of the vertical axis B–B' in the Figures.

The many features and advantages of the present invention are apparent from the detailed specification and it is intended by the appended claim to cover all such features and advantages of the described golf putter head and shaft assembly which follow in the true scope of the invention. Further, since numerous modifications and changes will readily occur to those of ordinary skill in the art, it is not desired to limit the invention to the exact implementation and operation illustrated and described. Accordingly, all suitable modifications and equivalents may be resorted to as falling within the scope of the invention.

What is claimed is:

1. A golf putter head for use in putting a golf ball, the golf putter head comprising:

a base member having a front face for contacting a golf ball, the front face extending in a direction along an axis of elongation of the base member; and a rigid wing member having an end mounted to the base member along a connection interface extending at least 2.5 centimeters in the direction along the axis of elongation of the base member, a second end of the wing member opposite the end mounted to the base member extending behind the base member, and the length of the connection interface between the wing member and base member being less than the length of the base member measured along the axis of elongation of the base member.

2. A golf putter head as claimed in claim 1 wherein the wing member is mounted to the base member at a central portion thereof between its heel and toe portions.

3. A golf putter head as claimed in claim 1 further comprising:

an extension member having first and second ends, the first end coupled to a second end of the wing member opposite the end mounted to the base member; and a connection member having first and second portions, the first end of the connection member coupled to the second end of the extension member.

4. A golf putter head as claimed in claim 3 wherein the second portion of the connection member is coupled to a shaft assembly.

5. A golf putter head as claimed in claim 4 wherein the extension member is arched between its connections with the wing member and shaft assembly.

6. A golf putter head as claimed in claim 3 wherein the extension member and wing member join at a position behind the base member.

7. A golf putter head as claimed in claim 3 wherein the end of the wing member is relatively wide in the direction of elongation of the base member where it is mounted to the base member as compared to the second end that is coupled to the extension member.

8. A golf putter head as claimed in claim 3 wherein the center of the coupling between the wing member and the extension member, and the center of the coupling between the extension member and the connection member, lie substantially in a vertical plane wherein said plane bisects the front face of the golf putter head and said plane is normal to the axis of elongation of the base member.

9. A golf putter head as claimed in claim 1 wherein the base member has a rear surface defining at least one recessed surface to distribute the weight of the base member so that the toe and heel weigh more than the central portion of the base member.

10. A golf putter head as claimed in claim 1 wherein the base member defines respective recessed surfaces in the heel, central, and toe portions thereof.

11. A golf putter head as claimed in claim 1 wherein progressively from a sole of the base member upward, the base member has a bottom portion defining the sole, an intermediate portion coupled to the wing member, and a top ridge portion.

12. A golf putter head as claimed in claim 11 wherein the golf putter head has alignment marks on the top ridge, and the toe and heel portions of the bottom portion of the base member.

13. A golf putter head as claimed in claim 1 wherein the golf putter head has alignment marks at toe, heel, and central portions thereof.

14. A golf putter head as claimed in claim 1 wherein a distance from a sole of the base member to an upper surface of a top ridge portion of the base member is at least one-half of the diameter of a USGA golf ball.

15. A golf putter head as claimed in claim 1 wherein a distance from a sole of the base member to an upper surface of a top ridge portion of the base member is at least 2.0 centimeters.

16. A golf putter head as claimed in claim 1 wherein the base member has a front face that slopes at most −1° degrees of angle.

17. A golf putter head as claimed in claim 1 wherein the wing member extends along a plane that is tilted from 30° to 60° degrees of angle with respect to a vertical axis direction.

18. A golf putter head as claimed in claim 1 wherein the connection interface of the wing member to the base member extends at least the width of a golf ball along the axis of elongation of the base member.

19. A golf putter head as claimed in claim 1 wherein the connection interface of the wing member to the base member extends at least 4.5 centimeters in a direction along the axis of elongation of the base member.

20. A golf putter head as claimed in claim 1 wherein the coupling between the wing member and the extension member is centrally located on the wing member.

21. A golf putter head as claimed in claim 20 wherein the coupling between the extension member and the connection member is centrally located on the extension member.

22. A golf putter comprising:

a base member having a front face for contacting a golf ball, the front face extending in a direction along an axis of elongation of the base member;

a rigid wing member having an end mounted to the base member, the wing member mounted to the base member along a connection interface extending at least 2.5 centimeters in the direction along the axis of elongation of the base member; and a shaft assembly coupled to the wing member, a second end of the wing member opposite the end mounted to the base member extending behind the base member, and the length of the connection interface between the wing member and base member being less than the length of the base member measured along the axis of elongation of the base member.

23. A golf putter as claimed in claim 22 further comprising:

an extension member having first and second ends, the first end coupled to a second end of the wing member opposite the end mounted to the base member; and a connection member having first and second ends, the first end of the connection member coupled to the second end of the extension member, the second end of the connection member coupled to a shaft.

24. A golf putter as claimed in claim 23 wherein the extension member and wing member join at a position behind the base member.

25. A golf putter as claimed in claim 22 wherein the wing member is mounted to the base member at a central portion thereof between its toe and heel portions.

26. A golf putter as claimed in claim 22 wherein the base member has a rear surface defining at least one recessed surface to distribute the weight of the base member so that the toe and heel weigh more than the central portion of the base member.

27. A golf putter as claimed in claim 22 wherein a base member defines respective recess surfaces in the heel, central, and toe portions thereof.

28. A golf putter as claimed in claim 22 wherein a distance from a sole of the base member to an upper surface of a top ridge portion of the base member is at least one-half the diameter of a USGA golf ball.

29. A golf putter as claimed in claim 22 wherein a distance from a sole of the base member to an upper surface of a top ridge portion of the base member is at least 2.0 centimeters.

30. A golf putter as claimed in claim 22 wherein the base member has a front face that slopes at most −1° degrees of angle.

31. A golf putter as claimed in claim 22 wherein the connection interface of the wing member to the base member extends at least the width of a golf ball along the axis of elongation of the base member.

32. A golf putter as claimed in claim 22 wherein the connection interface of the wing member to the base member extends at least 4.5 centimeters along the axis of elongation of a base member.

* * * * *